US010821449B2

(12) United States Patent
Lin et al.

(10) Patent No.: US 10,821,449 B2
(45) Date of Patent: Nov. 3, 2020

(54) HYBRID SHOWER HEAD

(71) Applicant: FUJIAN XIHE SANITARY WARE TECHNOLOGY CO., LTD., Nan'An (CN)

(72) Inventors: Xiaofa Lin, Nan'An (CN); Xiaoshan Lin, Nan'An (CN); Zhigang Wan, Nan'An (CN); Xiaoqing Deng, Nan'An (CN); Qiqiao Liu, Nan'An (CN)

(73) Assignee: FUJIAN XIHE SANITARY WARE TECHNOLOGY CO., LTD, Nan'An (CN)

( * ) Notice: Subject to any disclaimer, the term of this patent is extended or adjusted under 35 U.S.C. 154(b) by 42 days.

(21) Appl. No.: 16/243,890

(22) Filed: Jan. 9, 2019

(65) Prior Publication Data

US 2020/0156090 A1 May 21, 2020

(30) Foreign Application Priority Data

Nov. 16, 2018 (CN) ..... 2018 2 1895764 U

(51) Int. Cl.
*B05B 1/18* (2006.01)
*E03C 1/04* (2006.01)

(52) U.S. Cl.
CPC ..... *B05B 1/185* (2013.01); *E03C 1/0409* (2013.01)

(58) Field of Classification Search
CPC ..... B05B 1/185
USPC ..... 4/601
See application file for complete search history.

(56) References Cited

U.S. PATENT DOCUMENTS 4,752,975 A * 6/1988 Yates ..... E03C 1/06 239/207
2012/0325353 A1 12/2012 Zhou et al.
2017/0259279 A1* 9/2017 Lin ..... B05B 1/16
2018/0180187 A1* 6/2018 Lin ..... F16K 11/0853

* cited by examiner

*Primary Examiner* — Lori L Baker
(74) *Attorney, Agent, or Firm* — Brooks Kushman P.C.

(57) ABSTRACT

A hybrid shower head includes: a first shower head including a first shower head portion and a positioning portion; a second shower head including a second shower head portion and a matching portion which is disengaged from or engaged with the positioning portion; a two-position three-way diverter valve including a first water outlet communicating with the first shower head portion and a second water outlet communicating with the second shower head portion; and a switch controlling the two-position three-way diverter valve to select a water path. When the positioning portion is engaged with the matching portion, water is automatically discharged from only one of the first water outlet and the second water outlet. When the positioning portion is disengaged from the matching portion, water is automatically discharged from the other of the first water outlet and the second water outlet.

13 Claims, 9 Drawing Sheets

HYBRID SHOWER HEAD

CROSS-REFERENCE TO RELATED APPLICATIONS

This disclosure claims priority to Chinese patent application No. 201821895764.1 filed on Nov. 16, 2018 and titled "Hybrid Shower Head", the entire content of which is hereby incorporated by reference.

TECHNICAL FIELD

The present application relates to the technical field of kitchen and bathroom appliances, in particular to a hybrid shower head.

BACKGROUND

At present, the hand-held shower head and the overhead shower head in the market are all in separated structures, and the water paths of the hand-held shower head and the overhead shower head are separately controlled. That is, the water path of the hand-held shower head is independently controlled to be opened or closed through a switch on the hand-held shower head water path, and the water path of the overhead shower head is independently controlled to be opened and closed through a switch on the overhead shower head water path.

For areas with insufficient water supply pressure, it is necessary to manually turn off the water path switch of the overhead shower head when using the hand-held shower head for discharging water, and to manually turn off the water path switch of the hand-held shower head when using the overhead shower head for discharging water, so as to avoid the condition of weak discharge when the hand-held shower head and the overhead shower head discharge water at the same time. Further, this kind of water path switching mode is cumbersome and the users' experience is not good.

SUMMARY

In order to solve at least one of the above problems, the application provides a hybrid shower head, which can simplify switching operation of the hand-held shower head and the overhead shower head, and improve the users' experience.

In order to achieve the purpose of the application, the hybrid shower head according to the present application includes: a first shower head including a first shower head portion and a positioning portion; a second shower head including a second shower head portion and a matching portion which is disengaged from or engaged with the positioning portion; a two-position three-way diverter valve including a first water outlet communicating with the first shower head portion and a second water outlet communicating with the second shower head portion; and a switch cooperating with the two-position three-way diverter valve for controlling the two-position three-way diverter valve to select a water path. When the positioning portion is disengaged from the matching portion, the switch controls the two-position three-way diverter valve to open one of the first water outlet and the second water outlet; and when the positioning portion is engaged with the matching portion, the switch controls the two-position three-way diverter valve to open the other of the first water outlet and the second water outlet.

Optionally, the two-position three-way diverter valve is a mechanical controlled pilot valve including: a valve seat provided with a water inlet, the first water outlet and the second water outlet; a valve core assembly installed in the valve seat, the valve core assembly being provided with a first pilot water outlet path and a second pilot water outlet path, the first pilot water outlet path connecting the water inlet and the first water outlet, the second pilot water outlet path connecting the water inlet and the second water outlet; and a movable rod movably inserted into the valve core assembly, at least one end of the movable rod extending out of the valve seat.

When the movable rod moves to a first position, the first pilot water outlet path is opened and the second pilot water outlet path is closed, and when the movable rod moves to a second position, the second pilot water outlet path is opened and the first pilot water outlet path is closed.

Optionally, the valve core assembly includes a water distributing seat, a first movable seal and a second movable seal, a first elastic member and a second elastic member, a first pressure relief member and a second pressure relief member which are sequentially arranged from a middle portion to both ends of the valve core assembly. The first movable seal, the second movable seal, and at least one of the first pressure relief member and the second pressure relief member all are sleeved on the movable rod. Water passing gaps are formed between the first movable seal and the movable rod and between the second movable seal and the movable rod. The water distributing seat is provided with a three-way channel. A first pressure holding chamber is formed between the water distributing seat and the first pressure relief member, and a second pressure holding chamber is formed between the water distributing seat and the second pressure relief member. An inlet of the three-way channel communicates with the water inlet, a first outlet of the three-way channel is connected with the first pressure holding chamber, and a second outlet of the three-way channel is connected with the second pressure holding chamber. The wall of the first pressure holding chamber is provided with a first distributing water outlet, and the wall of the second pressure holding chamber is provided with a second distributing water outlet. The first distributing water outlet and the second distributing water outlet are located between the first movable seal and the second movable seal. The first distributing water outlet communicates with the first water outlet, and the second distributing water outlet communicates with the second water outlet. The first pressure relief member is provided with a first pressure relief hole, and the second pressure relief member is provided with a second pressure relief hole. The first pressure relief hole communicates the first water outlet with the first pressure holding chamber, and the second pressure relief hole communicates the second water outlet with the second pressure holding chamber. A water path between the first outlet and the first water outlet is the first pilot water outlet path, and a water path between the second outlet and the second water outlet is the second pilot water outlet path. The movable rod is provided with a first blocking portion corresponding to the first pressure relief hole and a second blocking portion corresponding to the second pressure relief hole.

When the movable rod moves to the first position, the first blocking portion blocks the first pressure relief hole, the first movable seal blocks the first outlet, the second blocking portion releases the second pressure relief hole, and the second movable seal releases the second outlet.

When the movable rod moves to the second position, the second blocking portion blocks the second pressure relief hole, the second movable seal blocks the second outlet, the first blocking portion releases the first pressure relief hole, and the first movable seal releases the first outlet.

Optionally, the first movable seal and the second movable seal are diaphragms, and the first elastic member and the second elastic member are springs.

Optionally, a recess is arranged at each end of the water distributing seat. The first distributing water outlet and the second distributing water outlet are correspondingly positioned on side walls of both the recesses. The first outlet and the second outlet are correspondingly positioned on bottom walls of both the cavities. The first blocking portion is located in the first pressure holding chamber, and the second blocking portion is located in the second pressure holding chamber. The water inlet, the first water outlet and the second water outlet all are positioned on a side wall of the valve seat.

Optionally, the mechanical controlled pilot valve further includes a first return spring arranged on the movable rod for returning the movable rod to the first position or the second position.

Optionally, the mechanical controlled pilot valve is installed in the first shower head, and the switch includes: a rockable member hingedly installed in the first shower head, the end of the rockable member facing the movable rod being provided with a driving portion and the other end being provided with a magnetic member which corresponds to the positioning portion; a second return spring installed between the rockable member and the first shower head for resetting the rockable member; and a magnetic attraction member installed in the second shower head and corresponding to the matching portion.

Optionally, the mechanical controlled pilot valve is installed in the first shower head, and the switch includes: a rockable member hingedly installed in the first shower head, the end of the rockable member facing the movable rod being provided with a driving portion and the other end being provided with a projection which extends through the positioning portion and out of the first shower head; and a second return spring installed between the rockable member and the first shower head for resetting the rockable member.

Optionally, the driving portion is a driving surface.

Alternatively, the driving portion is an inclined guiding groove, and the movable rod is provided with a matching groove which is movably engaged into the inclined guiding groove.

Optionally, the first shower head is an overhead shower head, the second shower head is a hand-held shower head, the positioning portion is located below the first shower head portion, and the matching portion is located on the back side of the second shower head.

Compared with the prior art, the hybrid shower head according to the application is automatically switched so that: only one of the first shower head and the second shower head sprays water when the positioning portion and the matching portion are mated to assemble the first shower head and the second shower head together; and the other of the first shower head and the second shower head sprays water when the positioning portion and the matching portion are disengaged to separate the first shower head from the second shower head. The water switch mode of the first and second shower head is simple, and is more suitable for areas with insufficient water supply pressure, avoiding the condition that the first and second shower head spray water at the same time and improving the user experience.

Other features and advantages of the present application will be set forth in the description which follows, and in part will become apparent from the description, or may be learned by practicing the present application. The objects and other advantages of the present application may be realized and obtained by the structure described in the specification, claims and drawings.

BRIEF DESCRIPTION OF DRAWINGS

The drawings are intended to provide a further understanding of the technical scheme of the present application and form a part of the specification. The drawings together with the embodiments of the present application are used to explain the technical scheme of the present application and do not constitute a limitation on the technical scheme of the present application.

Figure 1:
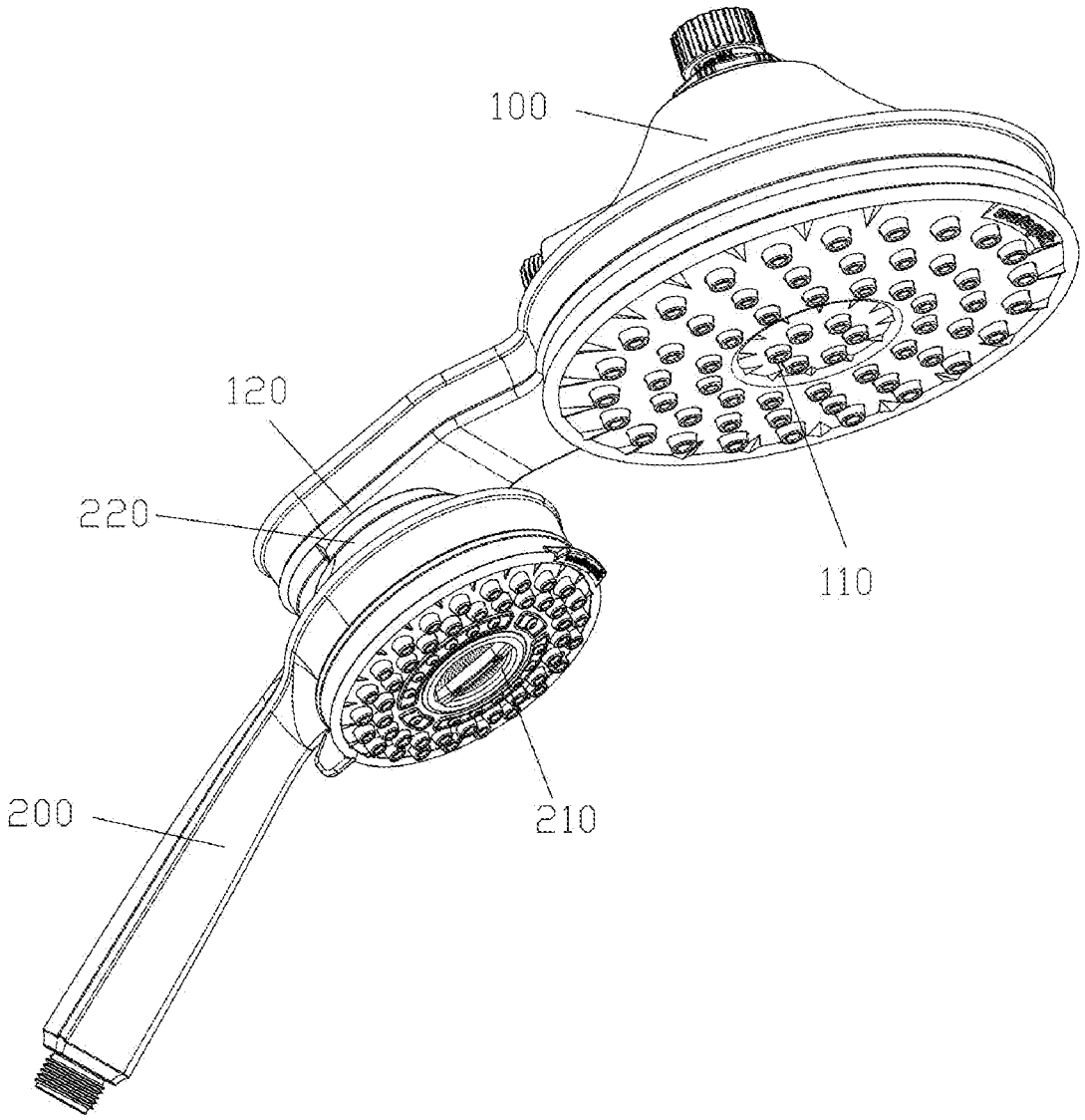
FIG. 1 is a perspective structural schematic view of a hybrid shower head according to an embodiment of the application.

The corresponding relationship between reference signs and components in FIGS. 1 to 10 is as follows:

100 first shower head, 110 first shower head portion, 120 positioning portion, 200 second shower head, 210 second shower head portion, 220 matching portion, 300 two-position three-way diverter valve, 301 first water outlet, 302 second water outlet, 303 water inlet, 311 valve seat body, 312 valve cover, 320 valve core assembly, 321 water distributing seat, 322 first movable seal, 323 second movable seal, 324 first elastic member, 325 second elastic member, 326 first pressure relief member, 327 second pressure relief member, 330 movable rod, 331 first blocking portion, 332 second blocking portion, 341 water passing gap, 342 first pressure holding chamber, 343 second pressure holding chamber, 344 first distributing water outlet, 345 second distributing water outlet, 346 first pressure relief hole, 347 second pressure relief hole, 351 inlet, 352 first outlet, 353 second outlet, 360 first return spring, 400 switch, 410 rockable member, 411 drive portion, 412 magnetic member, 413 projection, 420 second return spring, 430 magnetic attraction member.

DETAILED DESCRIPTION

In order to further clarify the purposes, technical schemes and advantages of this application, the embodiments of this application will be described in detail below with reference to the accompanying drawings. It should be noted that the embodiments in this application and the features thereof can be combined with each other in any way without confliction.

In the following description, many specific details are set forth in order to fully understand the application. However, the application may be implemented in other ways than those described herein, and therefore, the protection scope of the application is not limited by the specific embodiments disclosed below.

As shown in FIGS. 1, 5, 7 and 9, the hybrid shower head according to an embodiment of the application includes a first shower head 100 including a first shower head portion 110 and a positioning portion 120; a second shower head 200 including a second shower head portion 210 and a matching portion 220 which is disengaged from or engaged with the positioning portion 120; a two-position three-way diverter valve 300 including a first water outlet 301 communicating with the first shower head portion 110 and a second water outlet 302 communicating with the second shower head portion 210; and a switch 400 cooperating with the two-position three-way diverter valve 300 for controlling the two-position three-way diverter valve 300 to select a water path. When the positioning portion 120 is disengaged from the matching portion 220, the switch 400 controls the two-position three-way diverter valve 300 to open one of the first water outlet 301 and the second water outlet 302. When the positioning portion 120 is engaged with the matching portion 220, the switch 400 controls the two-position three-way diverter valve 300 to open the other of the first water outlet 301 and the second water outlet 302.

The hybrid shower head is automatically switched to actuate only one of the first shower head 100 and the second shower head 200 once the positioning portion 120 and the matching portion 220 are mated to assemble the first shower head 100 and the second shower head 200 together, and is automatically switched to actuate only the other of the first shower head 100 and the second shower head 200 once the positioning portion 120 and the matching portion 220 are disengaged so as to disengage the first shower head 100 and the second shower head 200. The water outlet switching mode of the first shower head 100 and the second shower head 200 is simple and more suitable for areas with insufficient water supply pressure, avoiding the situation of weak discharge when the first shower head 100 and the second shower head 200 spray water at the same time, and improving the users' experience.

The two-position three-way diverter valve 300 may be installed either on the first shower head 100 or on the second shower head 200. Both ways can achieve the purpose of this application and do not deviate from the design concept of this application. Thus, they fall within the protection scope of this application.

The following detailed description will take the following design as an example, in which the first shower head 100 is the overhead shower head, the second shower head 200 is the hand-held shower head, and the two-position three-way diverter valve 300 is mounted on the overhead shower head.

In this example, the positioning portion 120 is located below the first shower head portion 110 and the matching portion 220 is located on the back side of the second shower head portion 210, so that the second shower head 200 can be detachably mounted on the lower part of the first shower head portion 110.

Figure 2:
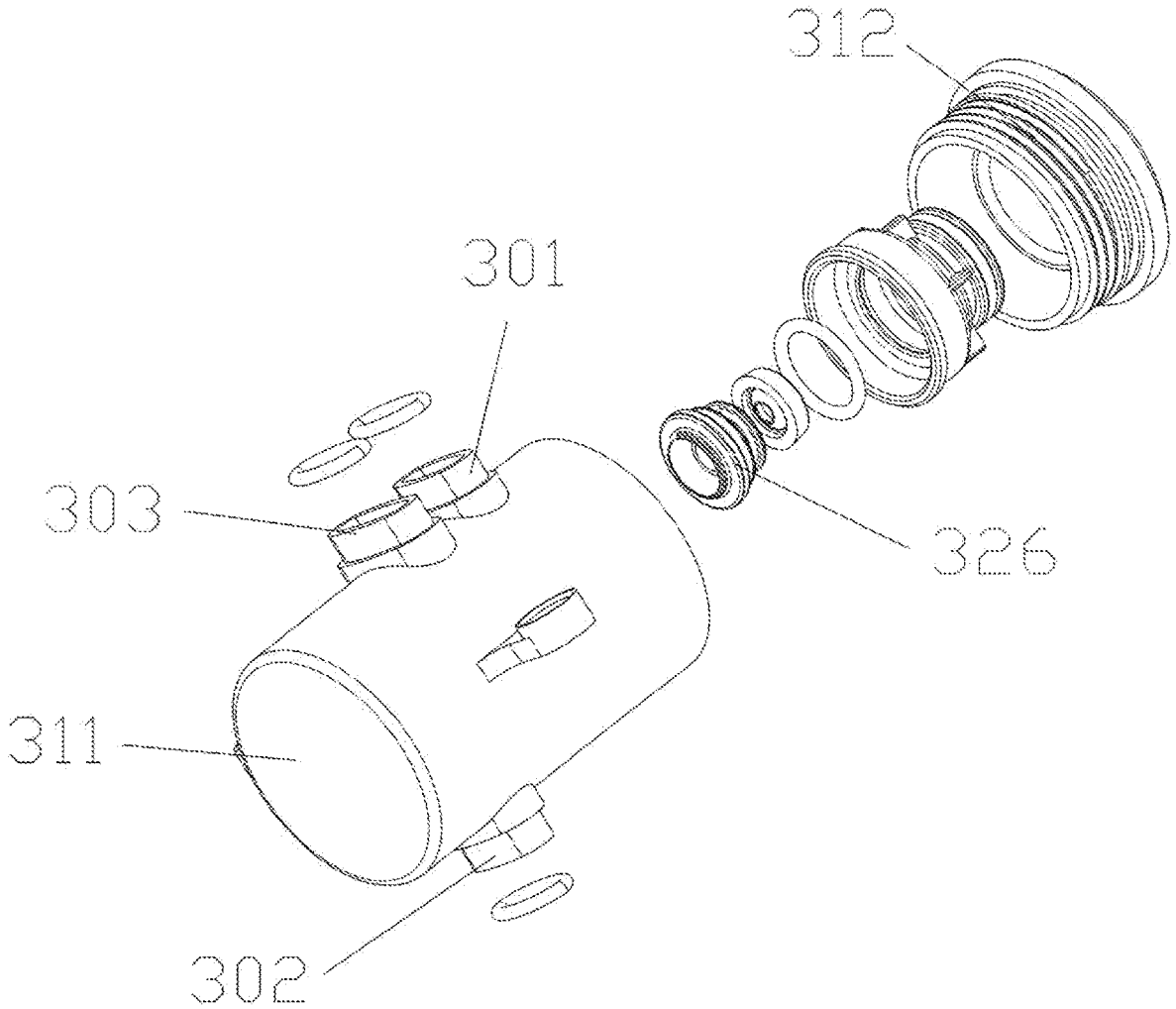
FIG. 2 is an exploded structural schematic view of the valve seat of the two-position three-way diverter valve in FIG. 1.
Figure 3:
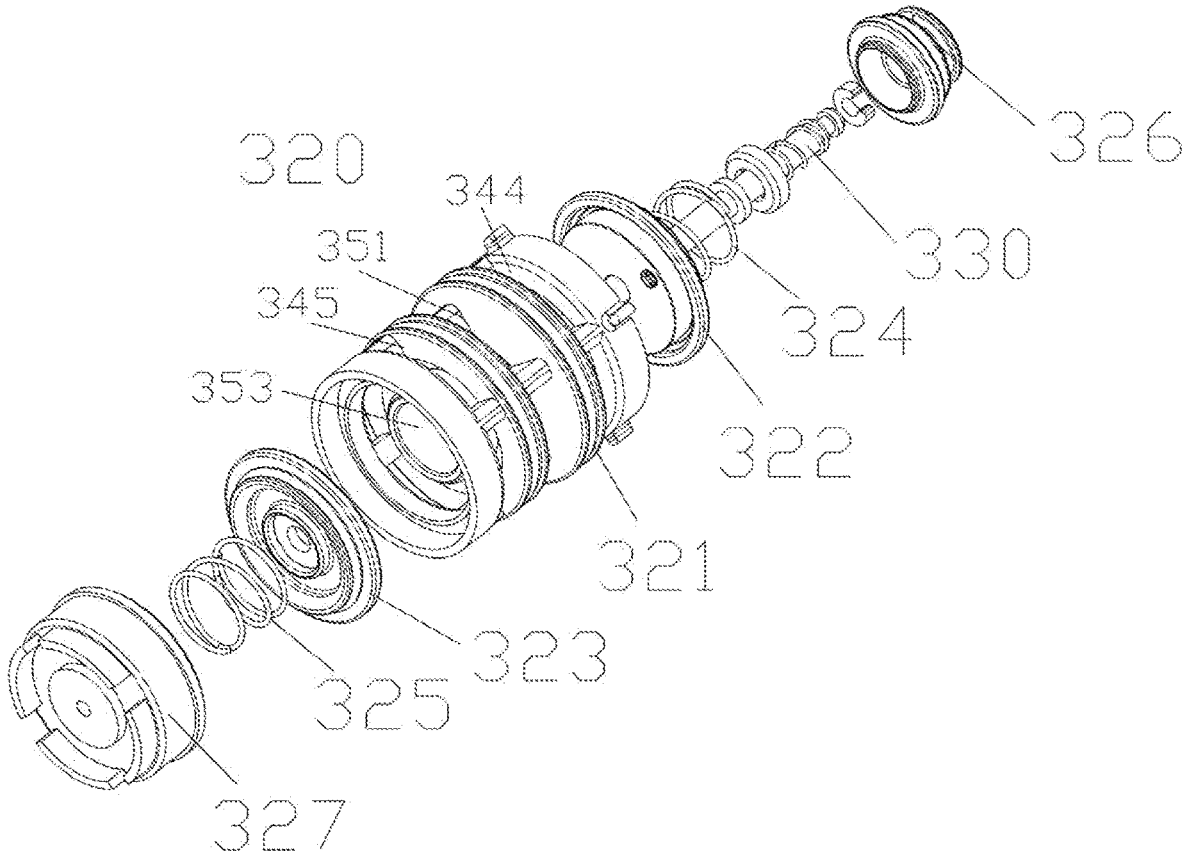
FIG. 3 is an exploded structural schematic view of the valve core assembly of the two-position three-way diverter valve in FIG. 1.

In an exemplary embodiment, as shown in FIGS. 2 and 3, the two-position three-way diverter valve 300 is a mechanical controlled pilot valve which includes a valve seat provided with a water inlet 303, a first water outlet 301 and a second water outlet 302; a valve core assembly 320 installed in the valve seat and provided with a first pilot water outlet path connecting the water inlet 303 and the first water outlet 301 and a second pilot water outlet path connecting the water inlet 303 and the second water outlet 302; and a movable rod 330 movably inserted in and mounted on the valve core assembly 320 and protrudes at one end out of the valve seat. The switch 400 cooperates with the protruding end so as to control the movable rod 330 to switch between a first position and a second position.

Removing the second shower head 200 from the first shower head 100 will cause the movable rod 330 to move to the first position in which position the first pilot water outlet path is opened and the second pilot water outlet path is closed. Positioning the second shower head 200 onto the first shower head 100 will cause the movable rod 330 to move to the second position, in which position the second pilot water outlet path is opened and the first pilot water outlet path is closed.

Specifically, as shown in FIGS. 2, 3 and 5-8, the valve core assembly 320 includes a water distributing seat 321, a first movable seal 322 and a second movable seal 323, a first elastic member 324 and a second elastic member 325, and a first pressure relief member 326 and a second pressure relief member 327 which are sequentially arranged from the middle portion to both ends.

The first pressure relief member 326, the first movable seal 322 and the second movable seal 323 are all sleeved on the movable rod 330. Water passing gaps 341 are provided between the first movable seal 322 and the movable rod 330 and between the second movable seal 323 and the movable rod 330. The water distributing seat 321 is provided with a three-way channel. A first pressure holding chamber 342 is formed between the water distributing seat 321 and the first pressure relief member 326, and a second pressure holding chamber 343 is formed between the water distributing seat 321 and the second pressure relief member 327. The inlet 351 of the three-way channel communicates with the water inlet 303, the first outlet 352 of the three-way channel is connected with the first pressure holding chamber 342, and the second outlet 353 of the three-way channel is connected with the second pressure holding chamber 343. The wall of the first pressure holding chamber 342 is provided with a first distributing water outlet 344, and the wall of the second pressure holding chamber 344 is provided with a second distributing water outlet 344. The first distributing water outlet 344 and the second distributing water outlet 345 are located between the first movable seal 322 and the second movable seal 323. The first distributing water outlet 344 communicates with the first water outlet 301, and the second distributing water outlet 345 communicates with the second water outlet 302.

Moreover, the first pressure relief member 326 is provided with a first pressure relief hole 346, and the second pressure relief member 327 is provided with a second pressure relief hole 347. The first pressure relief hole 346 communicates the first water outlet 301 with the pressure holding chamber 342 and the second pressure relief hole 347 communicates the second water outlet 302 with the second pressure holding chamber 343. The water path between the first outlet 352 and the first water outlet 301 is the first pilot water outlet path, and the water path between the second outlet 353 and the second water outlet 302 is the second pilot water outlet path. The movable rod 330 is provided with a first blocking portion 331 corresponding to the first pressure relief hole 346 and a second blocking portion 332 corresponding to the second pressure relief hole 347.

Figure 7:
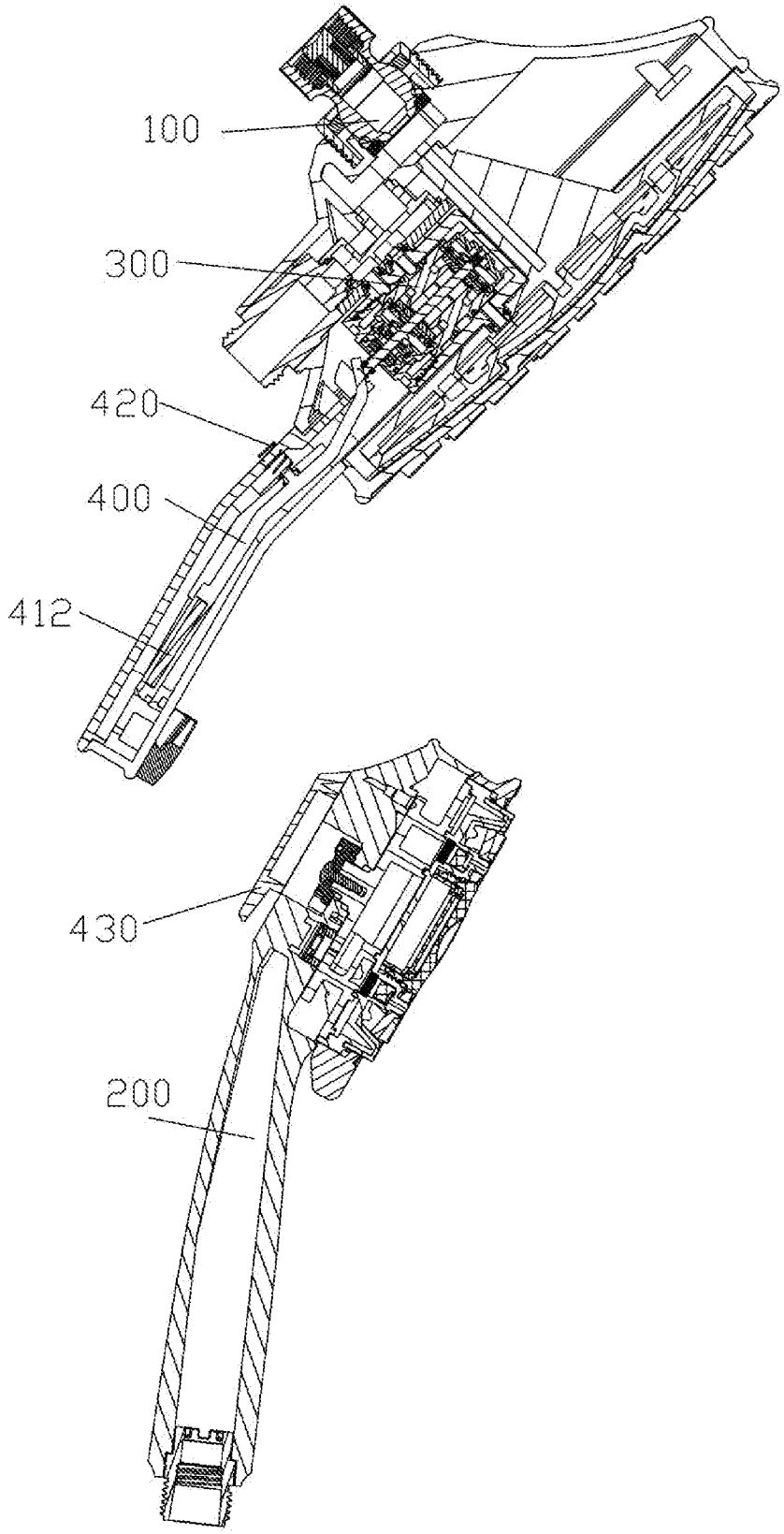
FIG. 7 is a cross-sectional structural schematic view of the overhead shower head and the hand-held shower head shown in FIG. 1 after being separated.
Figure 8:
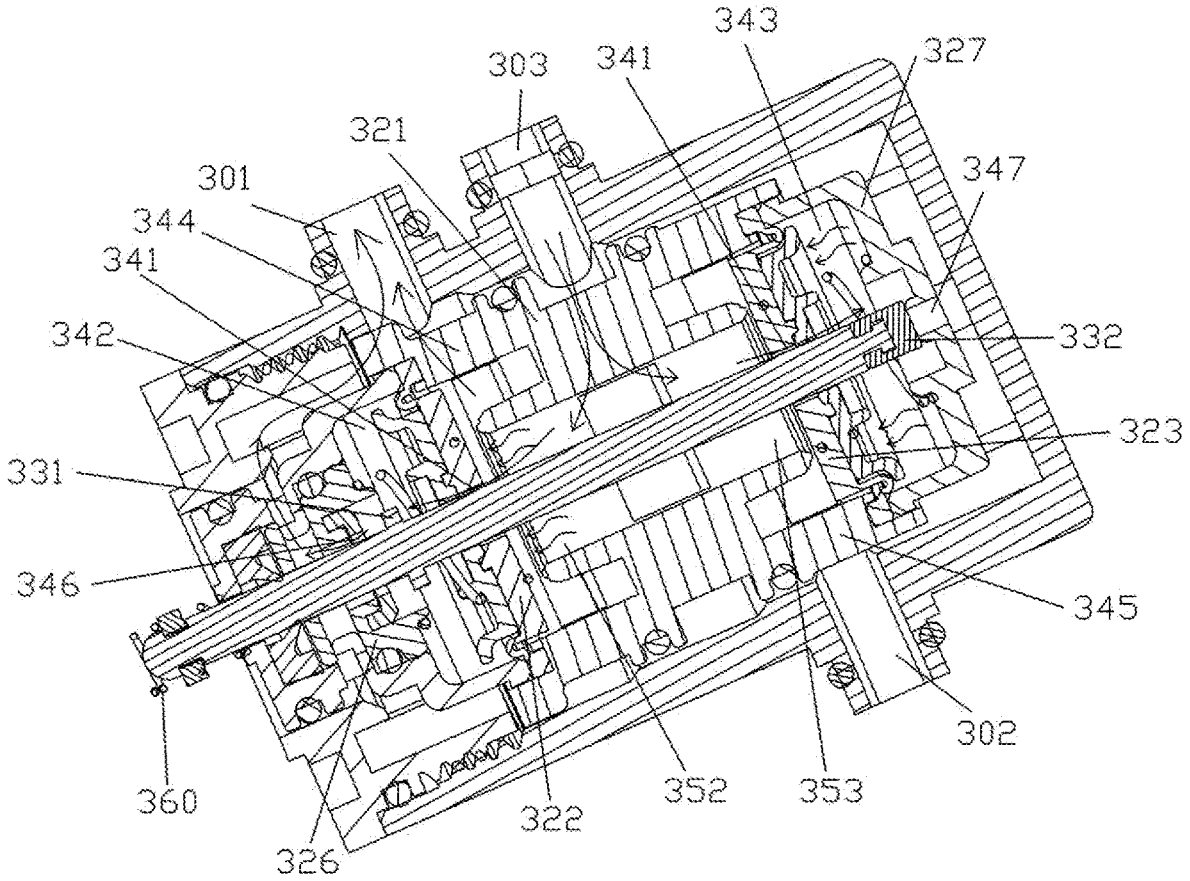
FIG. 8 is a schematic cross-sectional structural view of the two-position three-way diverter valve in FIG. 7.

As shown in FIG. 7 and FIG. 8, removing the second shower head 200 from the first shower head 100 causes the movable rod 330 to move to the first position where the first pressure relief hole 346 is blocked by the first blocking portion 331, the first outlet 352 is blocked by the movable seal 322, the second pressure relief hole 347 is released by the second blocking portion 332, and the second outlet 353 is released by the second movable seal 323.

Figure 5:
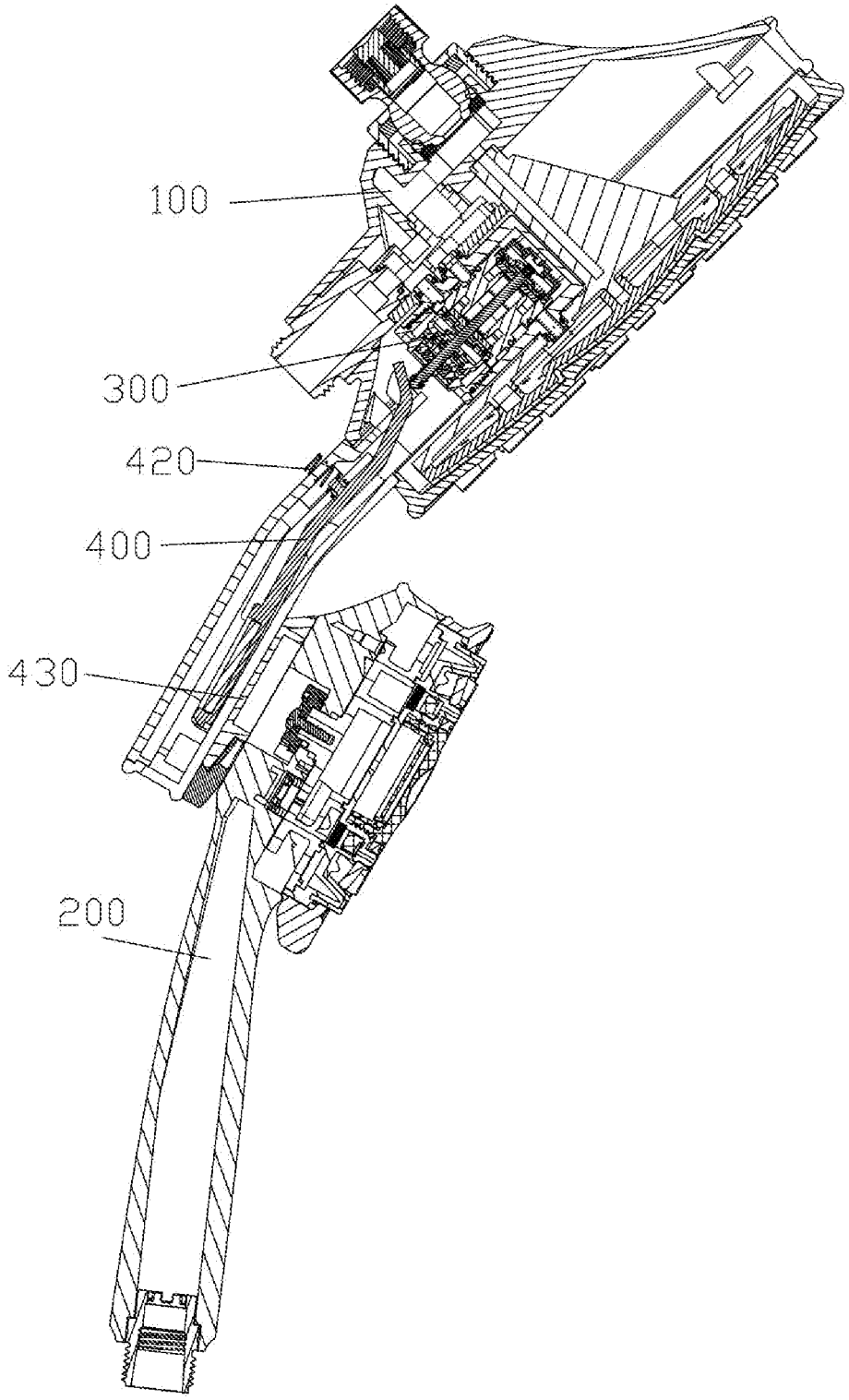
FIG. 5 is a main cross-sectional structural schematic view of the hybrid shower head shown in FIG. 1.
Figure 6:
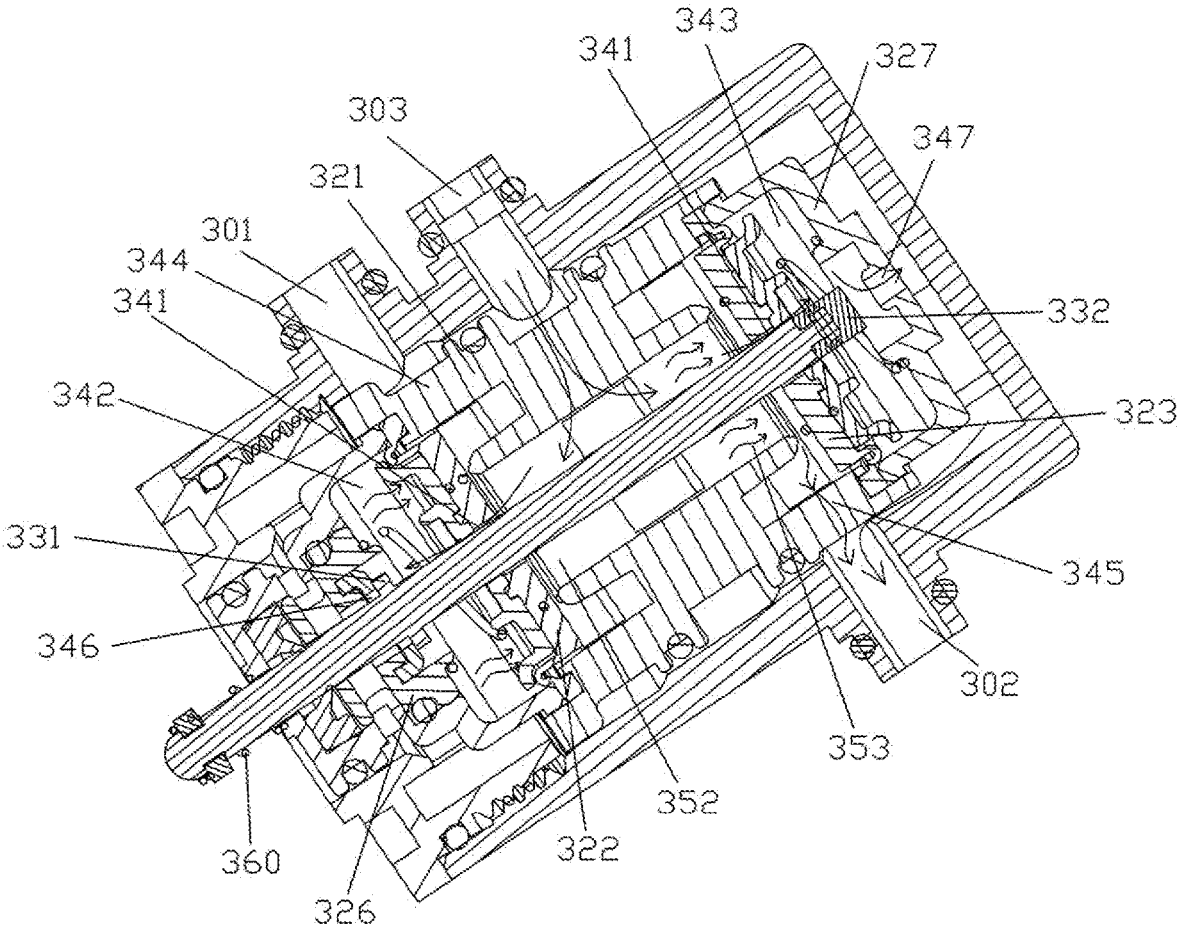
FIG. 6 is a cross-sectional structural schematic view of the two-position three-way diverter valve in FIG. 5.

As shown in FIG. 5 and FIG. 6, when the second shower head 200 is placed on the first shower head 100, the movable rod 330 moves to the second position where the second pressure relief hole 347 is blocked by the second blocking portion 332, the second outlet 353 is blocked by the second movable seal 323, the first pressure relief hole 346 is released by the first blocking portion 331, and the first outlet 352 is released by the first movable seal 322.

Preferably, as shown in FIGS. 2, 3 and 5-8, the first movable seal 322 and the second movable seal 323 are diaphragms, and the first elastic member 324 and the second elastic member 325 are springs. Each ends of the water distributing seat 321 is provided with a recess. The first distributing water outlet 344 and the second distributing water outlet 345 are correspondingly located on the sidewalls of the two recesses, and the first outlet 352 and the second outlet 353 are correspondingly located on the bottom walls of the two recesses. The inlet 351 is located on the outer side surface of the water distributing seat 321. The first blocking portion 331 is located in the first pressure holding chamber 342 and the second blocking portion 332 is located in the second pressure holding chamber 343. The water inlet 303, the first water outlet 301 and the second water outlet 302 are all located on the sidewall(s) of the valve seat. The first distributing water outlet 344 and the second distributing water outlet 345 are located between the first outlet 352 and the second outlet 353. The inlet 351 is located between the first distributing water outlet 344 and the second distributing water outlet 345.

Certainly, the first pressure relief member 326 and the second pressure relief member 327 may be located between the first blocking portion 331 and the second blocking portion 332, which can also achieve the purpose of this application and do not deviate from the design concept of this application. Thus, it falls within the protection scope of this application.

Furthermore, as shown in FIG. 3 and FIGS. 5 to 8, the mechanical controlled pilot valve further includes a first return spring 360 disposed on the movable rod 330 for returning the movable rod 330 to the second position.

As shown in FIG. 2, the valve seat may include a valve seat body 311 with an end open, a valve cover 312, and a seal. At the central portion of the valve cover 312 a hole through which the movable rod 330 protrudes is provided. The seal is used for sealing the movable rod 330.

Figure 4:
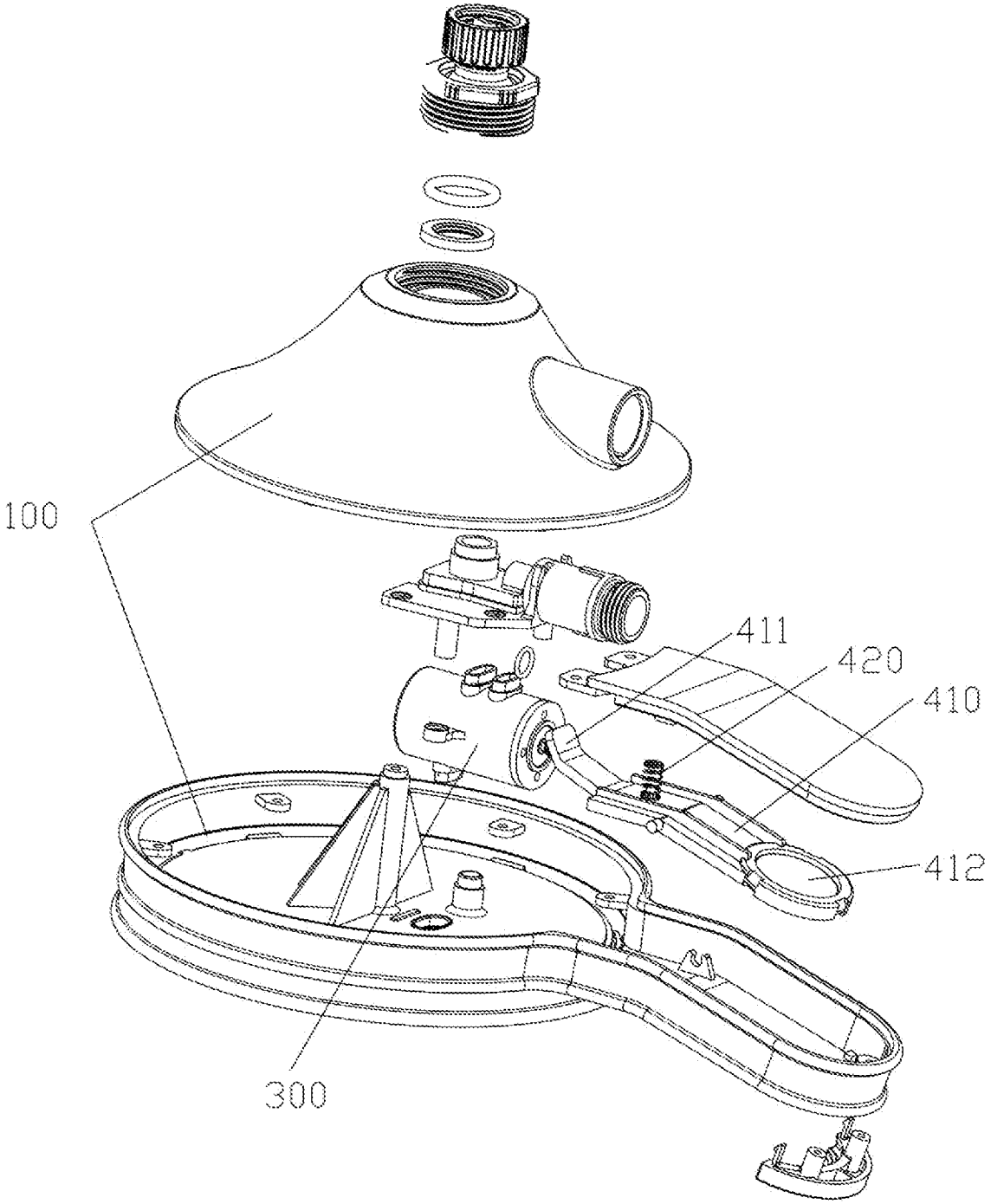
FIG. 4 is an exploded structural view of the overhead shower head in FIG. 1.

In an exemplary embodiment, as shown in FIGS. 4, 5 and 7, the switch 400 includes a rockable member 410, a second return spring 420, and magnetic attraction member 430. The rockable member 410 is hingedly mounted in the first shower head 100. The end of the rockable member 410 facing the movable rod 330 is provided with a driving portion 411, and the other end is provided with a magnetic member 412. The magnetic member 412 corresponds to the positioning portion 120. The second return spring 420 is installed between the rockable member 410 and the first shower head 100 for resetting the rockable member 410, such that the lower end of the rockable member 410 moves toward the back side of the lower end of the first shower head 100, after the first shower head 100 and the second shower head 200 are separated. The magnetic attraction member 430 is installed in the second shower head 200 and corresponds to the matching portion 220.

As shown in FIG. 5 and FIG. 6, when the hand-held shower head is hung on the lower portion of the overhead shower head, under the magnetic force of the magnetic member 412 and the magnetic attraction member 430, the end of the rockable member 410 facing the movable rod 330 moves in a positive direction to be separated from the movable rod 330. At this point, under the action of the first return spring 360, the movable rod 330 moves to the second position, the first blocking portion 331 blocks the first pressure relief hole 346, and the second blocking portion 332 releases the second pressure relief hole 347. Thus the water from the water inlet 303 enters respectively the first pressure holding chamber 342 and the second pressure holding chamber 343 through the water passing gaps 341. Since the water pressure in the three-way channel and the water pressure in the first pressure holding chamber 342 are balanced, the first elastic member 324 pushes the first movable seal 322 toward the water distributing seat 321 such that the first movable seal 322 blocks the first outlet 352, thereby the first water outlet 301 stops supplying water to the hand-held shower head. Meanwhile, since the second pressure relief hole 347 is opened, the water in the second pressure holding chamber 343 flows through the second water outlet 302 from the second pressure relief hole 347. At this point, the water pressure in the second pressure holding chamber 343 is smaller than that in the three-way channel. Thus the water in the three-way channel pushes the second movable seal 323 away from the water distributing seat 321, and the second movable seal 323 releases the second outlet 353, thereby water is supplied to overhead shower head through the second water outlet 302.

As shown in FIG. 7 and FIG. 8, when the hand-held shower head is removed from the lower portion of the overhead shower head, under the magnetic force of the magnetic member 412 and the magnetic attraction member 430, the end of the rockable member 410 facing the movable rod 330 is moved in a negative direction to push the movable rod 330. At this point, the push force is greater than the biasing force of the first return spring 360, thereby the movable rod 330 moves to the first position, the first blocking portion 331 releases the first pressure relief hole 346, and the second blocking portion 332 blocks the second pressure relief hole 347. Thus the water from the water inlet 303 passes through the water passing gaps 341 and enters respectively the first pressure holding chamber 342 and the second pressure holding chamber 343. Since the water pressure in the three-way channel and the water pressure in the second pressure holding chamber 343 is balanced, the second elastic member 325 pushes the second movable seal 323 toward the water distributing seat 321 such that the second movable seal 323 blocks the second outlet 353, thereby the second water outlet 302 stops supplying water to the overhead shower head. Meanwhile, since the first pressure relief hole 346 is opened, the water in the first pressure holding chamber 342 flows through the first water outlet 301 from the first pressure relief hole 346. At this point, the water pressure in the first pressure holding chamber 342 is less than the water pressure in the three-way channel. Thus, the water in the three-way channel push the first movable seal 322 away from the water distributing seat 321 and the first movable seal 322 releases the first outlet 352, thereby the water is supplied to the hand-held shower head through the first water outlet 301.

Figure 9:
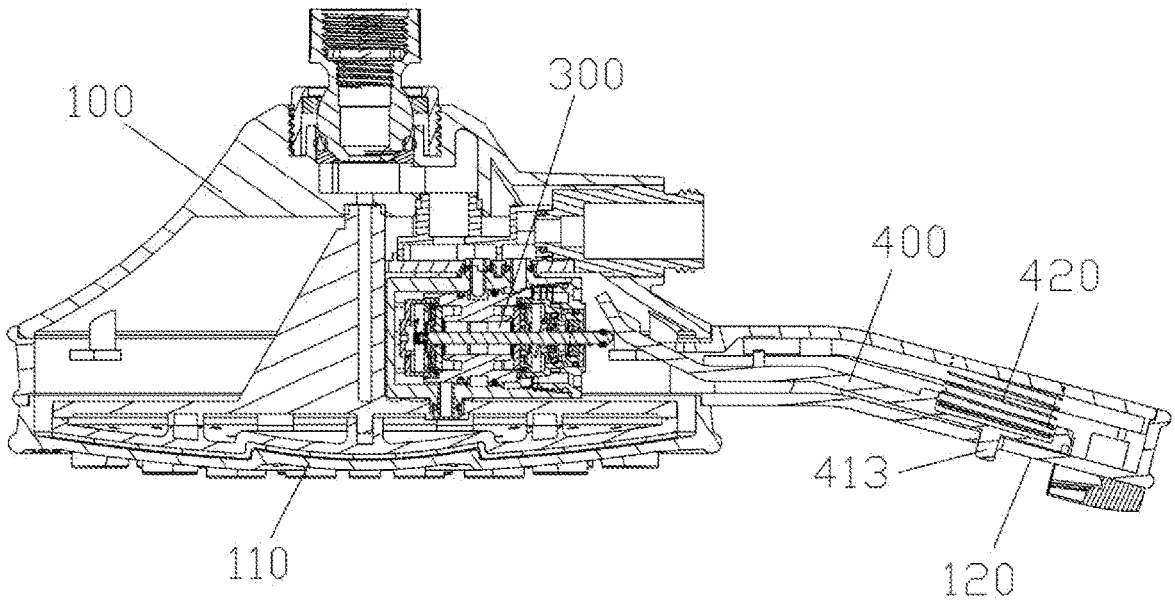
FIG. 9 is a schematic cross-sectional structural view of another embodiment of an overhead shower head.

Alternatively, as shown in FIG. 9, the switch 400 includes a rockable member 410 and the second return spring 420. The rockable member 410 is hingedly mounted in the first shower head 100. The end of the rockable member 410 facing the movable rod 330 is provided with a driving portion 411, and the other end is provided with a projection 413. The projection 413 extends through the positioning portion 120 and out of the first shower head 100. The second return spring 420 is installed between the rockable member 410 and the first shower head 100 for resetting the rockable member 410, so that the projection 413 remains extending out from the positioning portion 120, after first the shower head 100 and the second shower head 200 are separated. This embodiment can also achieve the goal of the present application, and does not deviate from the design concept of the present invention. Thus, it falls within the protection scope of this application.

Figure 10:
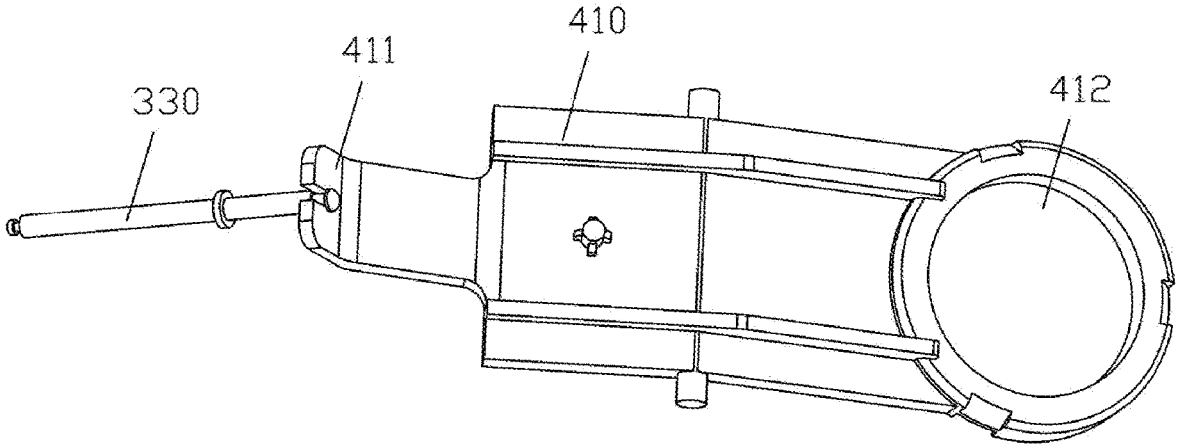
FIG. 10 is a schematic structural view of an embodiment of the movable rod and the rockable member.

It is possible that, as shown in FIGS. 4 and 9, the driving portion 411 is a driving surface which may be a slope or a curved surface, and the protruding end of the movable rod 330 abuts against the driving surface. Alternatively, as shown in FIG. 10, the driving portion 411 is an inclined guiding groove disposed on the driving surface, and the protruding end of the movable rod 330 is provided with a matching groove. The matching groove is movably engaged in the inclined guiding groove. When the rockable member 410 rocks, the matching groove moves along the inclined guiding groove, so that the movable rod is switched between the first position and the second position.

In summary, the hybrid shower head according to the present invention is automatically switched so that: only one of the first shower head and the second shower head sprays water when the positioning portion and the matching portion are mated to assemble the first shower head and the second shower head together; and the other of the first shower head and the second shower head sprays water when the positioning portion and the matching portion are disengaged to separate the first shower head from the second shower head. The water switch mode of the first and second shower head is simple, and is more suitable for areas with insufficient water supply pressure, avoiding the condition of weak discharge when the first and second shower head spray water at the same time and improving the users' experience.

In the description of the present application, the terms "mount", "join", "connect", "fix", etc. should be interpreted in general manner. For example, "connect" may refer to a fixed connection, a detachable connection, or an integral connection, and the elements can be connected directly or indirectly through an intermediate element. For those of ordinary skill in the art, the specific meanings of the above terms in the present application can be understood based on the context.

In the description of the present application, the terms "one embodiment", "some embodiments", "specific embodiments" and the like means that the specific features, structures, materials, or characteristics described in connection with the embodiments or examples are included in at least one embodiment or example of the present application. In the present specification, the schematic representation of the above terms does not necessarily refer to the same embodiment or example. Furthermore, the particular features, structures, materials, or characteristics described may be combined in a suitable manner in any one or more embodiments or examples.

The embodiments disclosed in the present application are described above, but the description is only for the purpose of understanding the present application, and is not intended to limit the present application. Any modification or change in the form and details of the embodiments may be made by those skilled in the art without departing from the concept and scope of the disclosure. The protection scope of the application is defined by the claims.

What we claim is:

1. A hybrid shower head comprising:

a first shower head including a first shower head portion and a positioning portion;

a second shower head including a second shower head portion and a matching portion which is disengaged from or engaged with the positioning portion;

a two-position three-way diverter valve including a first water outlet communicating with the first shower head portion and a second water outlet communicating with the second shower head portion; and a switch cooperating with the two-position three-way diverter valve for controlling the two-position three-way diverter valve to select a water path;

wherein when the positioning portion is disengaged from the matching portion, the switch controls the two-position three-way diverter valve to open one of the first water outlet and the second water outlet; and wherein when the positioning portion is engaged with the matching portion, the switch controls the two-position three-way diverter valve to open the other of the first water outlet and the second water outlet, wherein the two-position three-way diverter valve is a mechanical controlled pilot valve comprising:

a valve seat provided with a water inlet, the first water outlet and the second water outlet;

a valve core assembly installed in the valve seat, the valve core assembly being provided with a first pilot water outlet path and a second pilot water outlet path, the first pilot water outlet path connecting the water inlet and the first water outlet, the second pilot water outlet path connecting the water inlet and the second water outlet; and a movable rod movably inserted into the valve core assembly, at least one end of the movable rod extending out of the valve seat;

wherein when the movable rod moves to a first position, the first pilot water outlet path is opened and the second pilot water outlet path is closed, and when the movable rod moves to a second position, the second pilot water outlet path is opened and the first pilot water outlet path is closed, wherein the mechanical controlled pilot valve is installed in the first shower head, and the switch comprises:

a rockable member hingedly installed in the first shower head, wherein the end of the rockable member facing the movable rod is provided with a driving portion and the other end is provided with a magnetic member which corresponds to the positioning portion;

a second return spring installed between the rockable member and the first shower head for resetting the rockable member; and a magnetic attraction member installed in the second shower head and corresponding to the matching portion.

2. The hybrid shower head according to claim 1, wherein the valve core assembly comprises a water distributing seat, a first movable seal and a second movable seal, a first elastic member and a second elastic member, a first pressure relief member and a second pressure relief member which are sequentially arranged from a middle portion to both ends of the valve core assembly;

the first movable seal, the second movable seal, and at least one of the first pressure relief member and the second pressure relief member all being sleeved on the movable rod, water passing gaps being formed between the first movable seal and the movable rod and between the second movable seal and the movable rod;

the water distributing seat being provided with a three-way channel, a first pressure holding chamber being formed between the water distributing seat and the first pressure relief member, a second pressure holding chamber being formed between the water distributing seat and the second pressure relief member, an inlet of the three-way channel communicating with the water inlet, a first outlet of the three-way channel being connected with the first pressure holding chamber, a second outlet of the three-way channel being connected with the second pressure holding chamber, a first distributing water outlet being provided on a wall of the first pressure holding chamber, a second distributing water outlet being provided on a wall of the second pressure holding chamber, the first distributing water outlet and the second distributing water outlet being located between the first movable seal and the second movable seal, the first distributing water outlet communicating with the first water outlet, the second distributing water outlet communicating with the second water outlet;

the first pressure relief member being provided with a first pressure relief hole, the second pressure relief member being provided with a second pressure relief hole, the first pressure relief hole communicating the first water outlet with the first pressure holding chamber, the second pressure relief hole communicating the second water outlet with the second pressure holding chamber, a water path between the first outlet and the first water outlet being the first pilot water outlet path, a water path between the second outlet and the second water outlet being the second pilot water outlet path, the movable rod being provided with a first blocking portion corresponding to the first pressure relief hole and a second blocking portion corresponding to the second pressure relief hole;

wherein when the movable rod moves to the first position, the first blocking portion blocks the first pressure relief hole, the first movable seal blocks the first outlet, the second blocking portion releases the second pressure relief hole, and the second movable seal releases the second outlet; and wherein when the movable rod moves to the second position, the second blocking portion blocks the second pressure relief hole, the second movable seal blocks the second outlet, the first blocking portion releases the first pressure relief hole, and the first movable seal releases the first outlet.

3. The hybrid shower head according to claim 2, wherein the first movable seal and the second movable seal are diaphragms, and the first elastic member and the second elastic member are springs.

4. The hybrid shower head according to claim 2, wherein a recess being arranged at each end of the water distributing seat, the first distributing water outlet and the second distributing water outlet being correspondingly positioned on side walls of both the recesses, the first outlet and the second outlet being correspondingly positioned on bottom walls of both the recesses, the first blocking portion being located in the first pressure holding chamber, the second blocking portion being located in the second pressure holding chamber, the water inlet, the first water outlet and the second water outlet all being positioned on a side wall of the valve seat.

5. The hybrid shower head according to claim 1, wherein the mechanical controlled pilot valve further comprises:

a first return spring arranged on the movable rod for returning the movable rod to the first position or the second position.

6. The hybrid shower head according to claim 1, wherein the driving portion is a driving surface; or the driving portion is an inclined guiding groove, the movable rod being provided with a matching groove which is movably engaged into the inclined guiding groove.

7. The hybrid shower head according to claim 1, wherein the first shower head is an overhead shower head, the second shower head is a hand-held shower head, the positioning portion is located below the first shower head portion, and the matching portion is located on the back side of the second shower head.

8. The hybrid shower head according to claim 2, wherein the mechanical controlled pilot valve further comprises:

a first return spring arranged on the movable rod for returning the movable rod to the first position or the second position.

9. The hybrid shower head according to claim 3, wherein the mechanical controlled pilot valve further comprises:

a first return spring arranged on the movable rod for returning the movable rod to the first position or the second position.

10. The hybrid shower head according to claim 4, wherein the mechanical controlled pilot valve further comprises:

a first return spring arranged on the movable rod for returning the movable rod to the first position or the second position.

11. The hybrid shower head according to claim 2, wherein the first shower head is an overhead shower head, the second shower head is a hand-held shower head, the positioning portion is located below the first shower head portion, and the matching portion is located on the back side of the second shower head.

12. The hybrid shower head according to claim 3, wherein the first shower head is an overhead shower head, the second shower head is a hand-held shower head, the positioning portion is located below the first shower head portion, and the matching portion is located on the back side of the second shower head.

13. The hybrid shower head according to claim 4, wherein the first shower head is an overhead shower head, the second shower head is a hand-held shower head, the positioning portion is located below the first shower head portion, and the matching portion is located on the back side of the second shower head.

* * * * *